US005929720A

United States Patent [19]

Hirata et al.

[11] Patent Number: 5,929,720

[45] Date of Patent: Jul. 27, 1999

[54] ELECTROMAGNETIC WAVE MATCHING MATRIX USING A PLURALITY OF MIRRORS

[75] Inventors: Yosuke Hirata; Yoshika Mitsunaka; Kenichi Hayashi; Yasuyuki Itoh, all of Yokohama, Japan

[73] Assignee: Kabushiki Kaisha Toshiba, Kawasaki, Japan

[21] Appl. No.: 08/713,411

[22] Filed: Sep. 13, 1996

[30] Foreign Application Priority Data

Sep. 13, 1995 [JP] Japan ..... 7-235791

[51] Int. Cl.[6] ..... H01P 1/161

[52] U.S. Cl. ..... 333/125; 333/137; 333/21 R; 315/5

[58] Field of Search ..... 333/125, 137, 333/21 R; 343/779, 837; 315/5

[56] References Cited

U.S. PATENT DOCUMENTS

| | | | |
|---|---|---|---|
| 3,224,006 | 12/1965 | Hogy | 343/837 X |
| 4,260,993 | 4/1981 | Aubry et al. | 343/779 |
| 4,460,897 | 7/1984 | Gans | 343/754 |
| 4,504,806 | 3/1985 | Conn et al. | 333/241 |
| 4,588,962 | 5/1986 | Saito et al. | 333/137 X |
| 4,677,393 | 6/1987 | Sharma | 330/286 |
| 5,652,554 | 7/1997 | Krieg et al. | 315/5 X |

FOREIGN PATENT DOCUMENTS

| | | | |
|---|---|---|---|
| 167903 | 7/1991 | Japan | 333/125 |

OTHER PUBLICATIONS

Kitsuregawa et al; "The Four–Reflector Launcher for the Beam Waveguide"; *1970 G–AP Int'l Symposium*; Columbus Ohio U.S.A.; Sep. 14–16, 1970; pp. 94–99.

"Experimental Study of a Quasi–Optical Mode Converter for a 110 GHz Gyrotron", Blank et al., IR & MM Waves, Sendai, 1994, pp. 331–332.

"Design of a 1 MW–CW Caxial Gyrotron with Two Gaussian Beam Outputs", Hirata et al., IR & MM Waves, Sendai, 1994, pp. 71–72.

*Primary Examiner*—Benny T. Lee

*Attorney, Agent, or Firm*—Foley & Lardner

[57] ABSTRACT

An electromagnetic wave matching element makes it possible to reduce the cost of a transmission system to a great degree. An electromagnetic wave matching element is adapted to allow electromagnetic wave beams incident from an entrance to be reflected by using plural mirrors to couple these reflected electromagnetic wave beams to an external transmission system through an exit. Mirrors are used that have a shape adapted to receive the plural electromagnetic waves in a beam form and to output electromagnetic wave beams having a predetermined distribution in which the number of the output electromagnetic waves is different from the number of the received electromagnetic waves.

18 Claims, 19 Drawing Sheets

ELECTROMAGNETIC WAVE MATCHING MATRIX USING A PLURALITY OF MIRRORS

BACKGROUND OF THE INVENTION

1. Field of the Invention

This invention relates to an electromagnetic wave matching element adapted for converting electromagnetic waves outputted from a gyrotron equipment to transmit them to a transmission system such as corrugated waveguide, etc.

2. Description of the Prior Art

At present, systems using electromagnetic waves are being studied in order to heat plasma in a nuclear fusion reactor. As a large power high frequency oscillating source of the millimeter wave band, high order mode gyrotron equipments are considered to be promising candidates, and are on the way to development. Generally, the gyrotron equipment accelerates and rotates thermions (thermoelectrons) generated at a cathode portion of an electron gun in the electromagnetic field to allow a portion of the rotation energy of the electrons to resonate in a cavity resonator to thereby convert it into electromagnetic wave energy. This electromagnetic wave (chiefly millimeter wave) is converted into electromagnetic wave beams by a mode converter and a mirror system having a plurality of mirrors to output them to an external location.

In the gyrotron having output of MW class, there is a problem in that when millimeter waves are passed through an output window made up of a dielectric body, a rise in temperature by heating of the dielectric body takes place so that the output window may be damaged. In order to suppress rising in temperature of the output window composed of a dielectric body, there have been proposed an approach in which mode converter and the mirror system are used to split millimeter waves oscillated at the cavity resonator into plural millimeter wave beams to take out them from plural output windows, and the like.

The millimeter wave beams outputted from the gyrotron are ordinarily transmitted up to the nuclear fusion reactor through a transmission system such as corrugate (corrugated) waveguide, etc. In the case where millimeter wave beams are taken out from plural output windows, one transmission system is required with respect to one output beam. Accordingly, the necessity of preparing plural transmission systems with respect to the single gyrotron having plural outputs takes place.

When a gyrotron having plural outputs is made up in order to suppress breakage of the output window as stated above, the necessity of installing plural transmission systems with respect to a single gyrotron takes place, with the result that the manufacturing cost of the transmission system becomes extremely large.

SUMMARY OF THE INVENTION

This invention has been made in view of actual circumstances as described above, and its object is to provide an electromagnetic wave matching element capable of reducing cost of the transmission system.

A first aspect of an electromagnetic wave matching element according to this invention is directed to an electromagnetic wave matching element adapted for allowing electromagnetic wave beams incident thereto to be reflected by using plural mirrors to couple these reflected electromagnetic wave beams to an external transmission system through an exit, the plural mirrors having a shape adapted to receive plural electromagnetic waves in a beam form to output electromagnetic wave beams having a predetermined distribution in which the number of the electromagnetic wave beams is different from the number of the received electromagnetic wave beams.

Moreover, a second aspect of the electromagnetic wave matching element according to this invention is characterized in that, in the electromagnetic wave matching element of the first aspect, at least two mirrors of the plural mirrors are a phase correction mirror, and each of the phase correction mirrors has a shape adapted to change phase of the electromagnetic wave beams incident to the reflecting surface of the phase correction mirror by a predetermined quantity corresponding to the position of the reflecting surface.

Further, a third aspect of the electromagnetic wave matching element according to this invention is characterized in that, in the electromagnetic wave matching element of the second aspect, each of surface shapes of the phase correction mirrors is determined so that phase distribution of the incident electromagnetic wave beams at the surface of the phase correction mirror when the incident electromagnetic wave beams are caused to be propagated up to the phase correction mirror becomes equal to a phase distribution of electromagnetic wave beams having a distribution which indicates the complex conjugate relationship with respect to a distribution made by electromagnetic wave beams traveling in an opposite direction at the surface of the phase correction mirror when electromagnetic waves having a desired distribution at the exit are made to travel in the opposite direction so that they are propagated up to the phase correction mirror.

Further, a fourth aspect of the electromagnetic wave matching element according to this invention comprises: a body portion caused to be in a vacuum state therewithin, or within which insulating gas is hermetically sealed; an entrance portion provided at the body portion and adapted so that plural electromagnetic wave beams are incident thereto; plural mirrors provided within the body portion and adapted for allowing the plural electromagnetic wave beams incident through the entrance to be reflected in order to transmit them, each of the plural mirrors having a shape adapted to receive plural electromagnetic wave beams to output electromagnetic wave beams having a predetermined distribution in which the number of the electromagnetic wave beams is different from the number of the received electromagnetic wave beams; and an exit portion provided at the body portion and adapted for coupling the electromagnetic wave beams reflected by the mirror of the final stage of the plural mirrors to an external transmission system.

In addition, a fifth aspect of the electromagnetic wave matching element according to this invention is directed to an electromagnetic wave matching element comprising a body portion caused to be in a vacuum state therewithin, or within which insulating gas is hermetically sealed, an entrance portion provided at the body portion and adapted so that plural electromagnetic wave beams are incident thereto, plural mirrors provided within the body portion and adapted for allowing the plural electromagnetic wave beams incident through the entrance to be reflected in order to transmit them, and an exit portion provided at the body portion and adapted for coupling the electromagnetic wave beams reflected by the mirror of the final stage of the plural mirrors to a transmission system of the external, wherein at least two mirrors of the plural mirrors are a phase correction mirror, and each of surface shapes of the phase correction mirrors is determined so that phase distribution of the electromagnetic wave beams incident through the entrance portion at the surface of the phase correction mirror when the incident electromagnetic wave beams are caused to be propagated up to the phase correction mirror becomes equal to a phase distribution of electromagnetic wave beams having a distribution which indicates the complex conjugate relationship with respect to a distribution made by electromagnetic wave beams traveling in an opposite direction at the surface of the phase correction mirror when electromagnetic waves having a desired distribution at the exit are made to travel in the opposite direction so that they are propagated up to the phase correction mirror.

DESCRIPTION OF THE PREFERRED EMBODIMENTS

Preferred embodiments of an electromagnetic wave matching element according to this invention will now be described.

Figure 20:
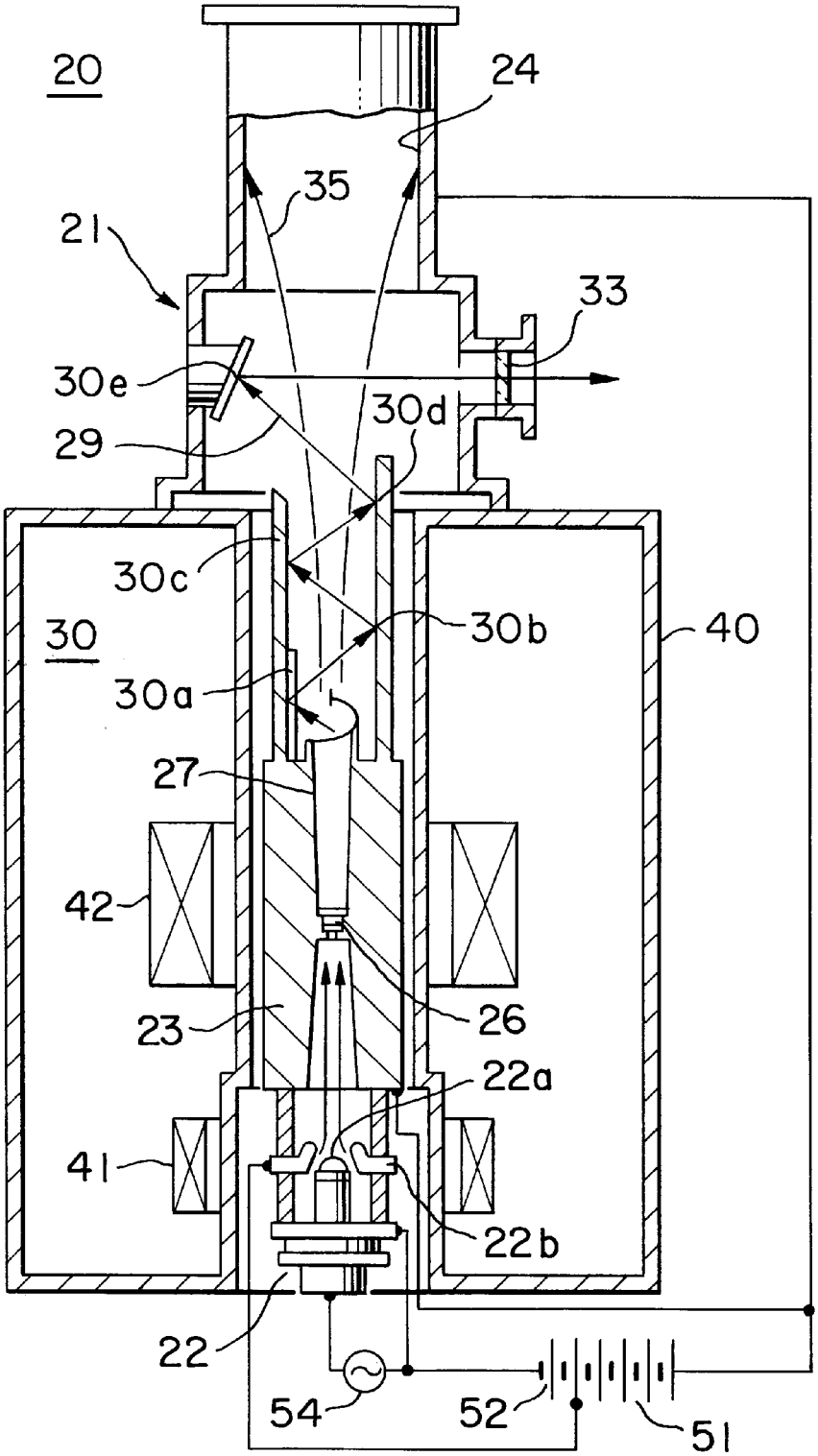
FIG. 20 is a schematic view showing the configuration of gyrotron equipment.

Initially, the gyrotron equipment will be briefly described below. The configuration of this gyrotron equipment 20 is shown in FIG. 20. This gyrotron equipment 20 includes a gyrotron oscillating tube body 21, and a superconducting magnet unit 40. The body 21 comprises an electron gun 22, a body portion 23, and a collector portion 24, wherein the electron gun 22 and the body portion 23 are inserted into a hole provided at the central portion of the superconducting magnet unit 40. The superconducting magnet unit 40 comprises a gun coil 41 formed in a manner to surround the electron gun 22, and a main coil 42 formed in a manner to surround the body portion 23.

The electron gun 22 includes a cathode portion 22*a* and an anode portion 22*b*. A d.c. voltage 52 is applied across the cathode portion 22*a* and the anode portion 22*b*, and a d.c. voltage 51 is applied across the cathode portion 22*a* and the collector portion 24. Moreover, the cathode portion 22*a* is heated by a heater power supply 54 to emit thermions (thermoelectrons). These emitted thermions are accelerated by the electric field between the cathode 22*a* and the anode 22*b*, and are inputted to a cavity resonator 26 provided within the body portion 23 while rotating around lines of magnetic force produced by the main coil 42 and the gun coil 41. At the cavity resonator 26, the rotation frequency of electrons and the natural frequency of the cavity resonator 26 are substantially equal to each other, and a portion of rotation energy of electrons is resonantly converted into energy of electromagnetic waves to produce electromagnetic waves (particularly millimeter waves). These produced millimeter waves are propagated to a mirror system 30 composed of mirrors 30*a*, 30*b*, 30*c*, 30*d*, 30*e* through a mode converter 27. These millimeter waves are then converted into millimeter wave beams 29 by the mode converter 27 and mirror system 30, and are sent out to an external transmission system through an output window 33 made up of a dielectric body. In this case, electrons 35 passed through the cavity resonator are attracted by the collector 24.

Figure 1:
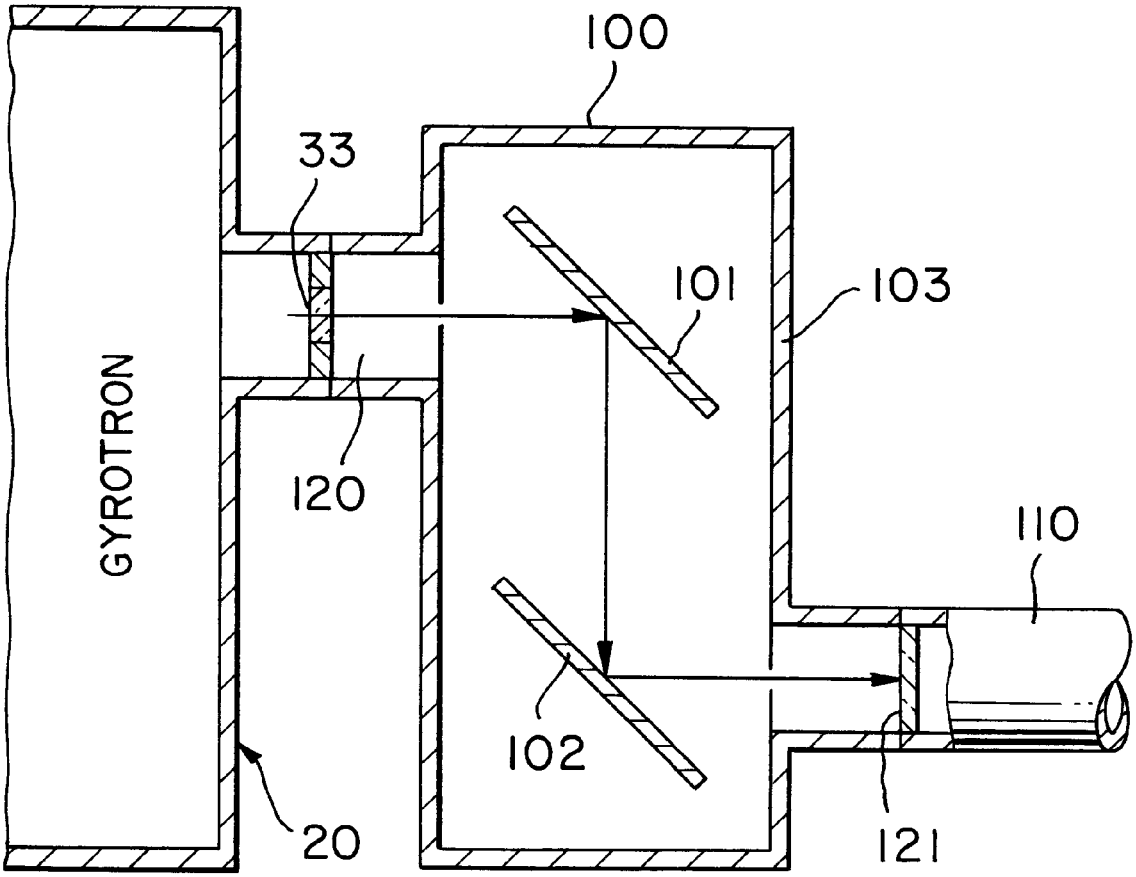
FIG. 1 is a cross sectional view showing the configuration of a first embodiment of an electromagnetic wave matching element according to this invention.
Figure 2:
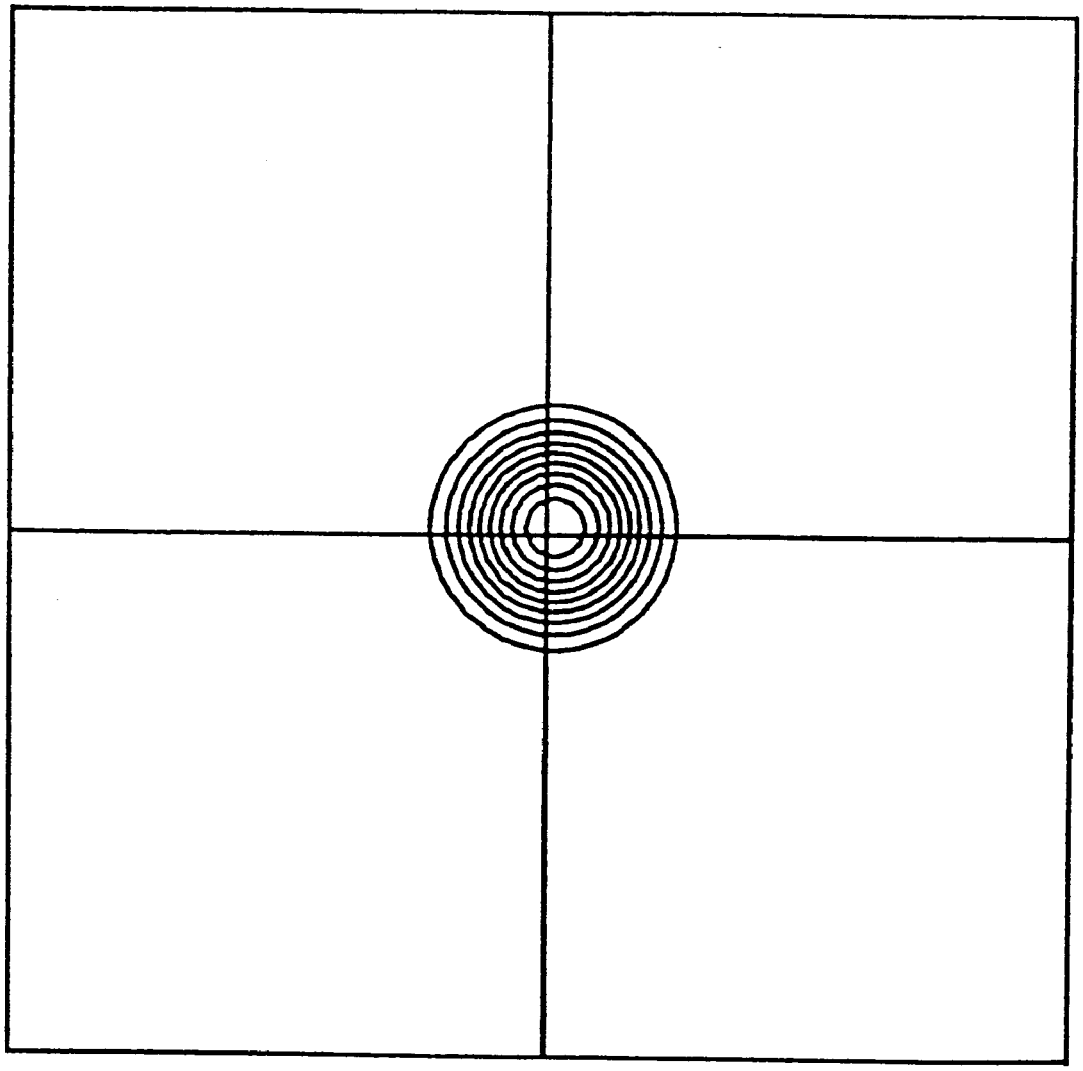
FIG. 2 is a plan view of power distribution of electromagnetic waves in the fundamental mode $HE_{11}$ of corrugated waveguide.
Figure 3:
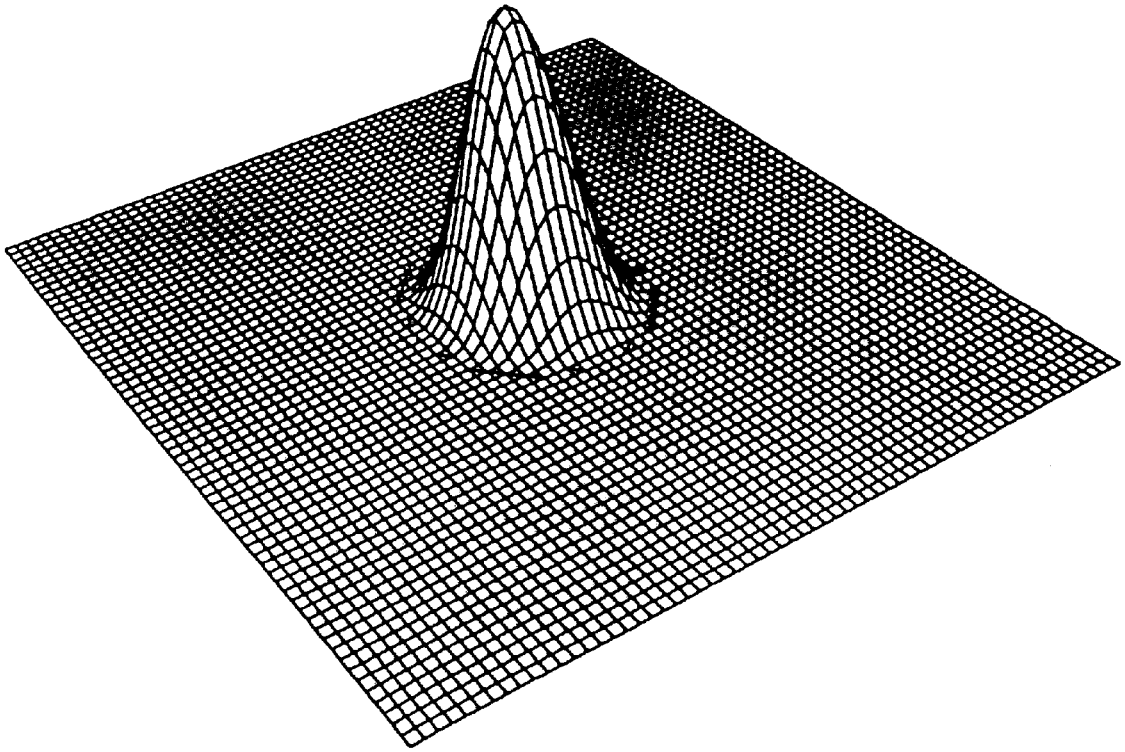
FIG. 3 is a perspective view of power distribution of electromagnetic waves in the fundamental mode $HE_{11}$ of the corrugated waveguide.

The configuration of a first embodiment of an electromagnetic wave matching element which is the major portion of this invention is shown in FIG. 1. The electromagnetic wave matching element 100 of this embodiment comprises, e.g., two phase correction mirrors 101, 102 provided within a space (e.g., in a vacuum state) surrounded by a vacuum wall 103, and serves to receive, from an entrance 120, e.g., two millimeter wave beams having flattened intensity distribution outputted from the output window 33 of the gyrotron equipment 20 to convert them into electromagnetic wave (millimeter wave) beams of the $HE_{11}$ mode, which is the fundamental mode of a corrugated waveguide 110, by using the phase correction mirrors 101, 102, to send them out to the corrugated waveguide 110 through an exit 121. The exit 121 is a window which, for example, is made up of a dielectric body to keep the interior of the matching element 100 in a vacuum state when the interior of the corrugated waveguide 110 is not kept in a vacuum state. The plan view and the perspective view of power distribution of electromagnetic waves of the fundamental mode $HE_{11}$ at the entrance of the corrugated waveguide 110 are respectively shown in FIGS. 2 and 3. FIG. 2 is a plan view in which power distribution of electromagnetic waves of the fundamental mode $HE_{11}$ is expressed with contour lines. In FIG. 2, a contour line is drawn for every tenth of the maximum value of the power distribution. FIG. 3 is a perspective view in which power distribution of electromagnetic waves of the fundamental mode $HE_{11}$ is expressed with meshes to show the power distribution in a three-dimensional perspective.

In FIG. 1, e.g., two millimeter waves of which intensity distribution (power distribution) has been flattened outputted from the output window 33 of the gyrotron equipment 20 are incident (inputted) to the phase correction mirror 101, by which they are reflected so that their phases are corrected. The reflected millimeter waves thus obtained are propagated up to the phase correction mirror 102. Then, their phases are corrected by the phase correction mirror 102 for a second time so that they are converted into millimeter wave beams of the $HE_{11}$ mode. The millimeter wave beams thus obtained are propagated to the corrugated waveguide 110.

It is now assumed that conversion from, e.g., two millimeter wave beams of which intensity distribution has been flattened to millimeter wave beams of the $HE_{11}$ mode can be made by the above-described two phase correction mirrors 101, 102. In this case, when millimeter waves of the $HE_{11}$ mode are inputted from the exit of the electromagnetic wave matching element 100, i.e., the entrance of the corrugate wave guide 110 to the electromagnetic wave matching element 100, two millimeter waves having a flat intensity distribution should be obtained at the entrance 120 of the electromagnetic wave matching element 100, i.e., the exit path of the gyrotron equipment 20.

At this time, if the above-described conversion can be completely carried out, phase distributions within the plane traversing the travelling direction of millimeter waves with respect to millimeter waves (beams) traveling from the entrance to the exit of the matching element and millimeter waves (beams) traveling from the exit to the entrance thereof have the complex conjugate relationship because their traveling directions are opposite to each other. Namely, in all regions including the surfaces of two phase correction mirrors, the phase of the input millimeter wave beams traveling in the positive direction (from the entrance to the exit of the electromagnetic wave matching element 100) and the phase of millimeter wave beams having a distribution that indicates the complex conjugate relationship with respect to the output millimeter wave beams traveling in the opposite direction should be in correspondence with each other.

Figure 4:
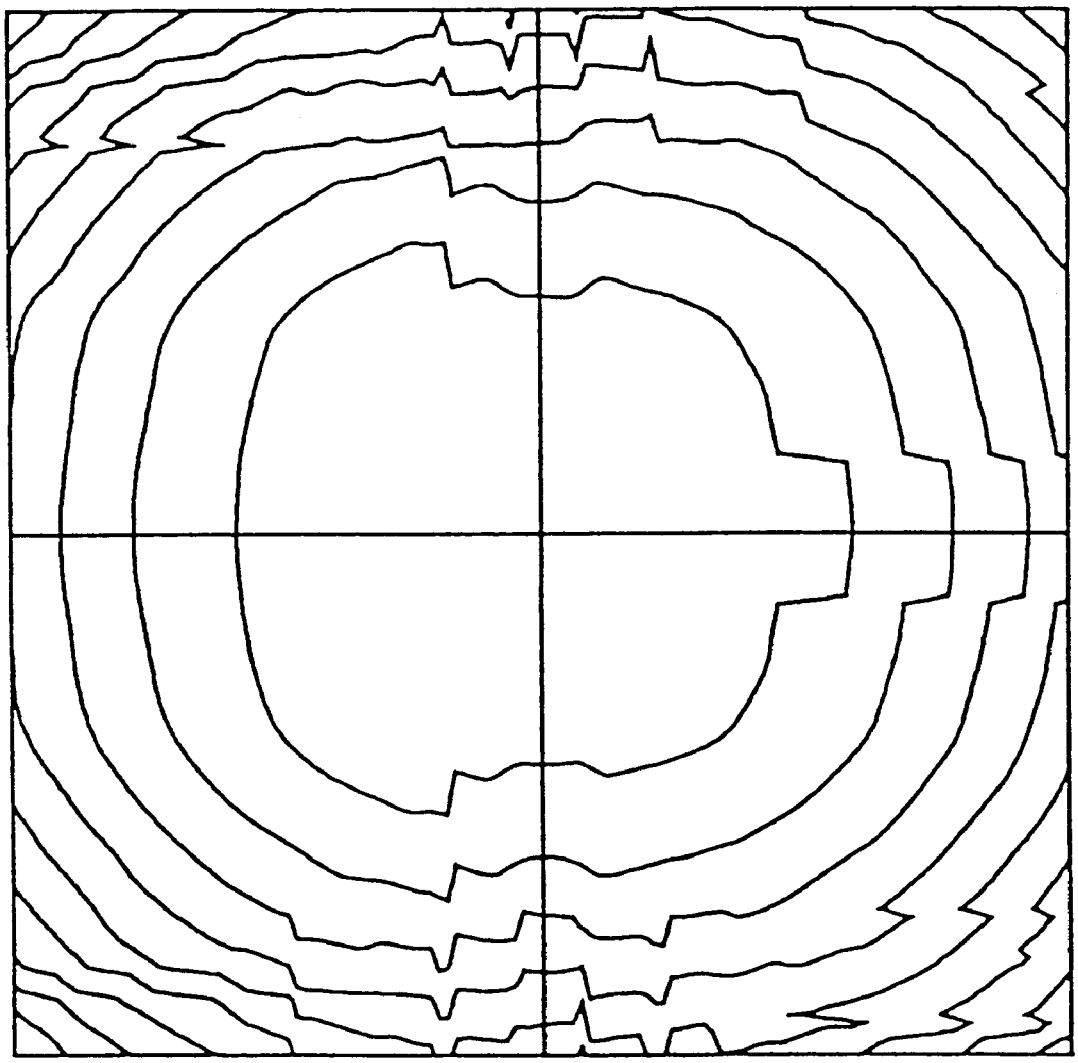
FIG. 4 is a plan view of phase correction mirror according to the first embodiment of this invention.
Figure 5:
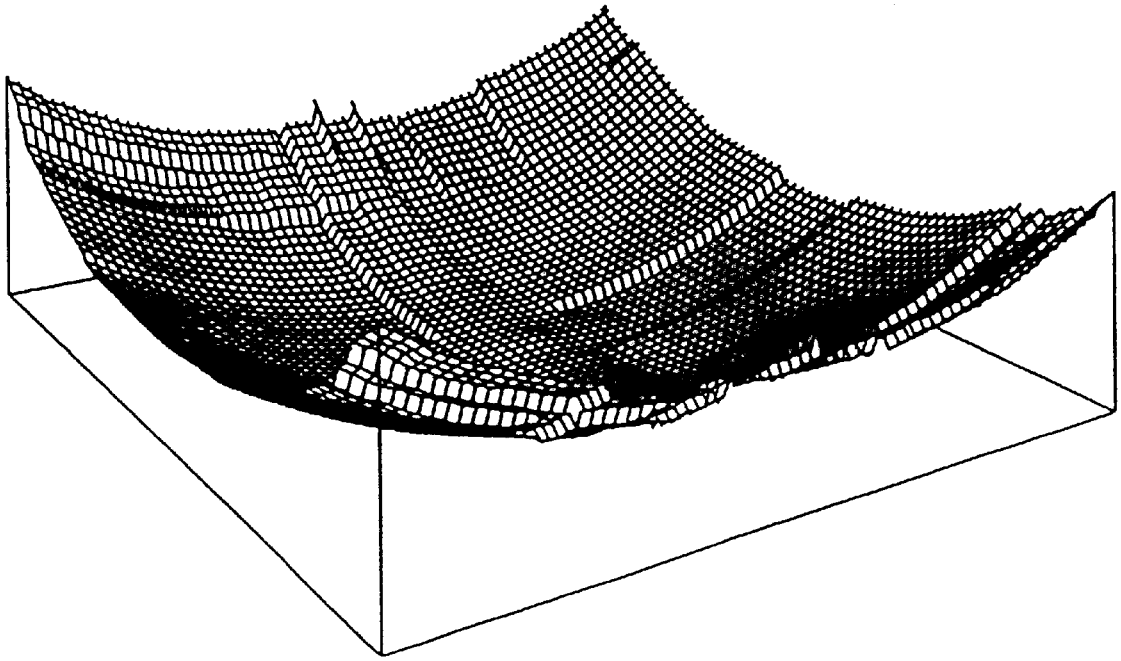
FIG. 5 is a perspective view showing surface shape of phase correction mirror according to the first embodiment of this invention.
Figure 6:
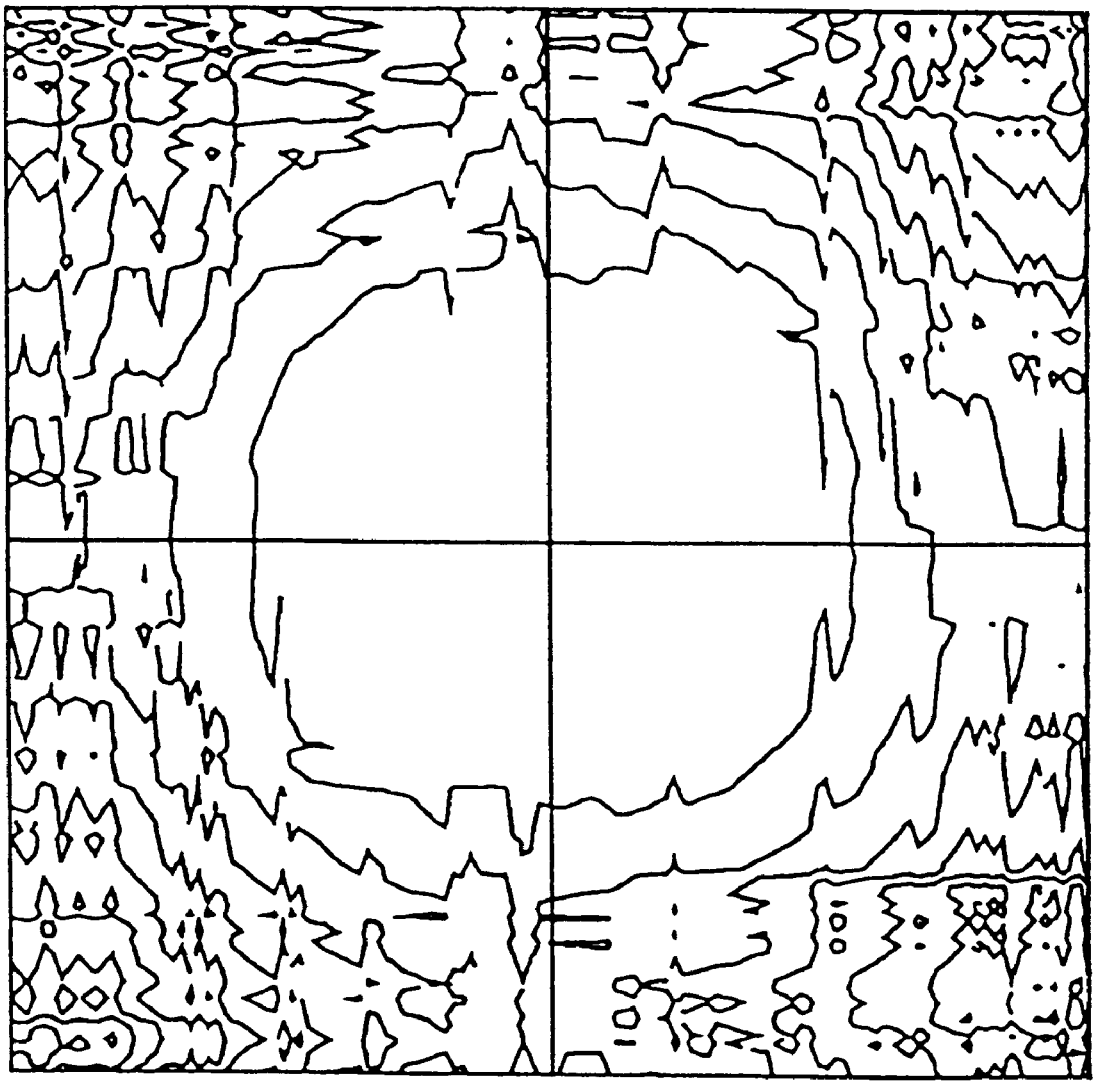
FIG. 6 is a plan view of the phase correction mirror according to the first embodiment of this invention.
Figure 7:
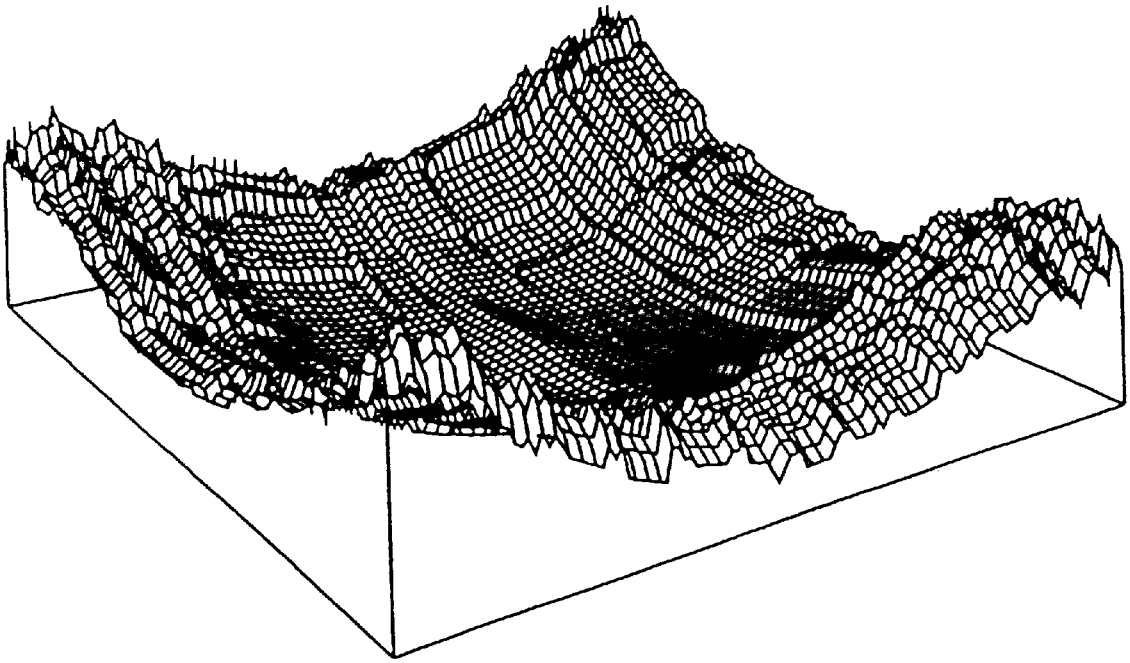
FIG. 7 is a perspective view showing surface shape of the phase correction mirror according to the first embodiment of this invention.

Accordingly, in order to aim at realization of the state where the above-described complete conversion can be made, it is sufficient to employ an approach to propagate, in the opposite direction, target millimeter wave beams from the exit of the electromagnetic matching element 100 to determine, by repetitive calculation, surface shapes of the phase correction mirrors 101, 102 so that the phase of millimeter wave beams having a distribution that indicates the complex conjugate relationship with respect to the beams traveling in the opposite direction and the phase of the input millimeter wave beams are respectively in correspondence with each other at the both surfaces of the two phase correction mirrors 101, 102. The plan view and the perspective view of the surface of the phase correction mirror 101 determined in this way are respectively shown in FIGS. 4 and 5, and the plan view and the perspective view of the surface of the phase correction mirror 102 are respectively shown in FIGS. 6 and 7. FIG. 4 is a plan view in which the surface of the phase correction mirror 101 is expressed with contour lines. In FIG. 4, a contour line is drawn for every tenth of the maximum height of the surface of the phase correction mirror 101. FIG. 5 is a perspective view in which the surface of the phase correction mirror 101 is expressed with meshes to show the surface in a three-dimensional perspective. FIG. 6 is a plan view in which the surface of the phase correction mirror 102 is expressed with contour lines. In FIG. 6, a contour line is drawn for every tenth of the maximum height of the surface of the phase correction mirror 102. FIG. 7 is a perspective view in which the surface of the phase correction mirror 102 is expressed with meshes to show the surface in a three-dimensional perspective.

As has been described above, in accordance with the electromagnetic wave matching element of this embodiment, it becomes possible to combine plural millimeter wave beams outputted from a single gyrotron into a single millimeter wave beam. Thus, the cost of the transmission system can be reduced.

Additionally, in the electromagnetic wave matching element 100 of the above-described embodiment, a cooling member path (not shown) for cooling the phase correction mirrors 101, 102, and an absorbing member, etc. (not shown) for absorbing loss millimeter waves that are scattered on the mirror, etc., and are not emitted from the exit, are provided in addition to the phase correction mirrors 101, 102.

Figure 8A:
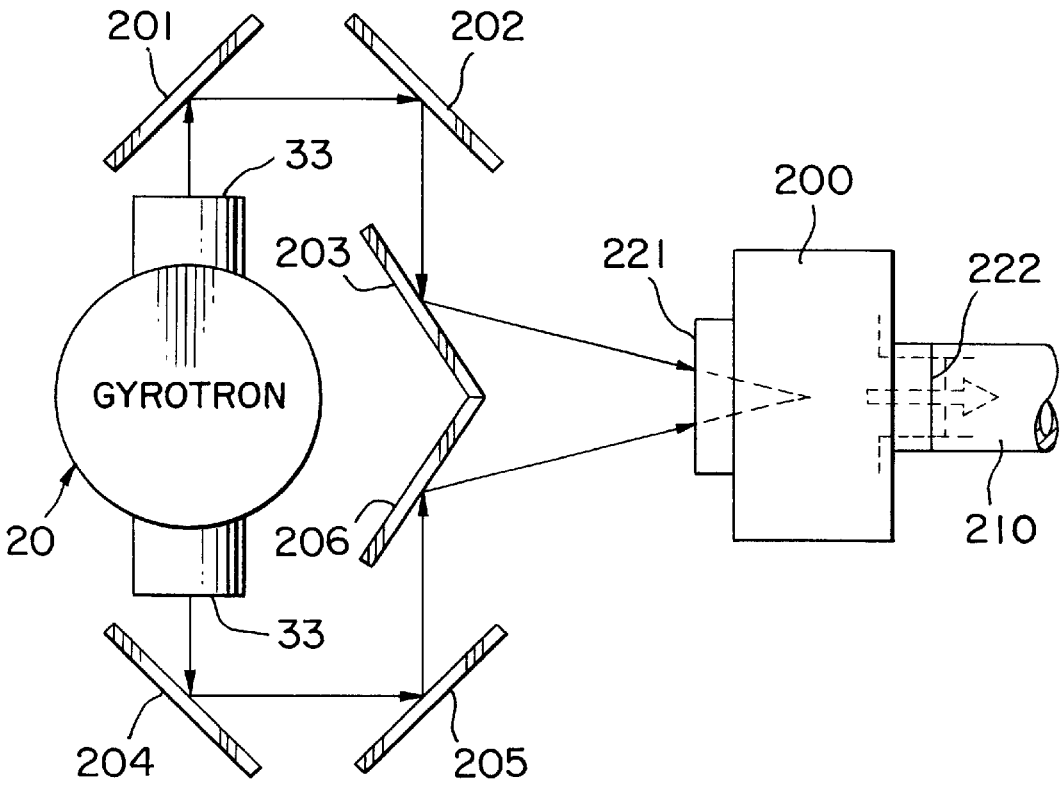
FIG. 8A is a top view of a second embodiment of an electromagnetic wave matching element according to this invention.
Figure 8B:
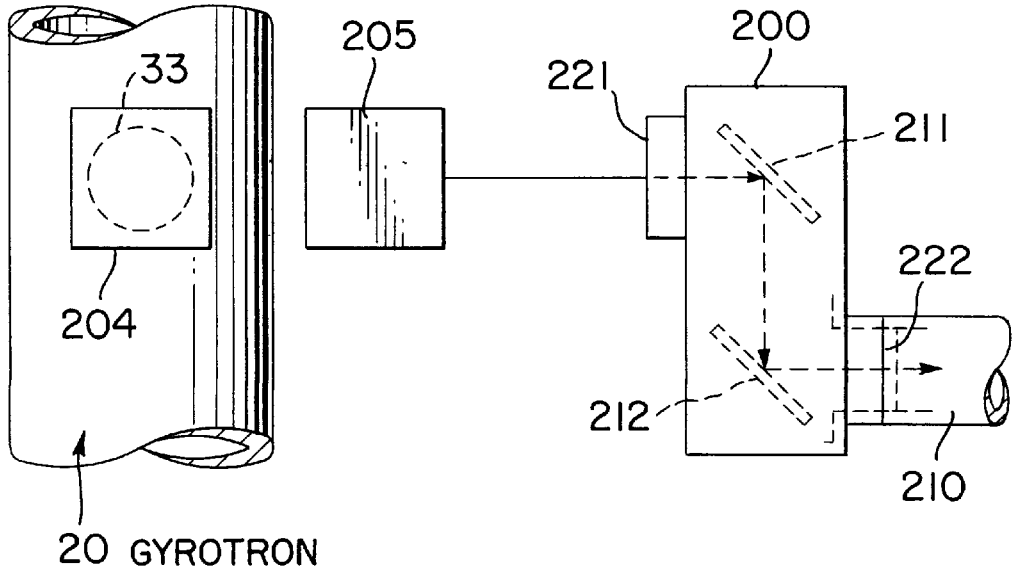
FIG. 8B is a side view of the second embodiment of the electromagnetic wave matching element according to this invention.

The configuration of a second embodiment of the electromagnetic wave matching element which is the principal part of this invention is shown in FIGS. 8A and 8B. The electromagnetic wave matching element 200 of this embodiment comprises two phase correction mirrors 211, 212 (see FIG. 8B) provided within a space (e.g., in vacuum state) surrounded by a vacuum wall, and serves to convert two millimeter beams of which output directions are different from each other by 180 degrees outputted from the output window 33 of the gyrotron 20 into a desired single millimeter wave beam to output it to a corrugated waveguide 210. The top view and the side view thereof are respectively shown in FIGS. 8A and 8B. One millimeter wave beam of the two millimeter wave beams outputted from the gyrotron 20 is reflected in order by reflection mirrors 201, 202 and 203, (each seen in FIG. 8A) and is propagated to an entrance 221 of the electromagnetic wave matching element 200 of this embodiment. The other millimeter wave beam is reflected in order by reflection mirrors 204, 205, 206, (see FIG. 8B) and is propagated to the entrance 221 of the electromagnetic wave matching element 200.

In the electromagnetic wave matching element 200 of this embodiment, two millimeter wave beams propagated are synthesized by phase correction mirrors 211, 212 to output a synthesized one as a single millimeter wave beam to the corrugated waveguide through an exit 222. By employing such an approach, it is possible to determine shapes of the phase correction mirrors 211, 212 in the same manner as in the case of the first embodiment.

Figure 9:
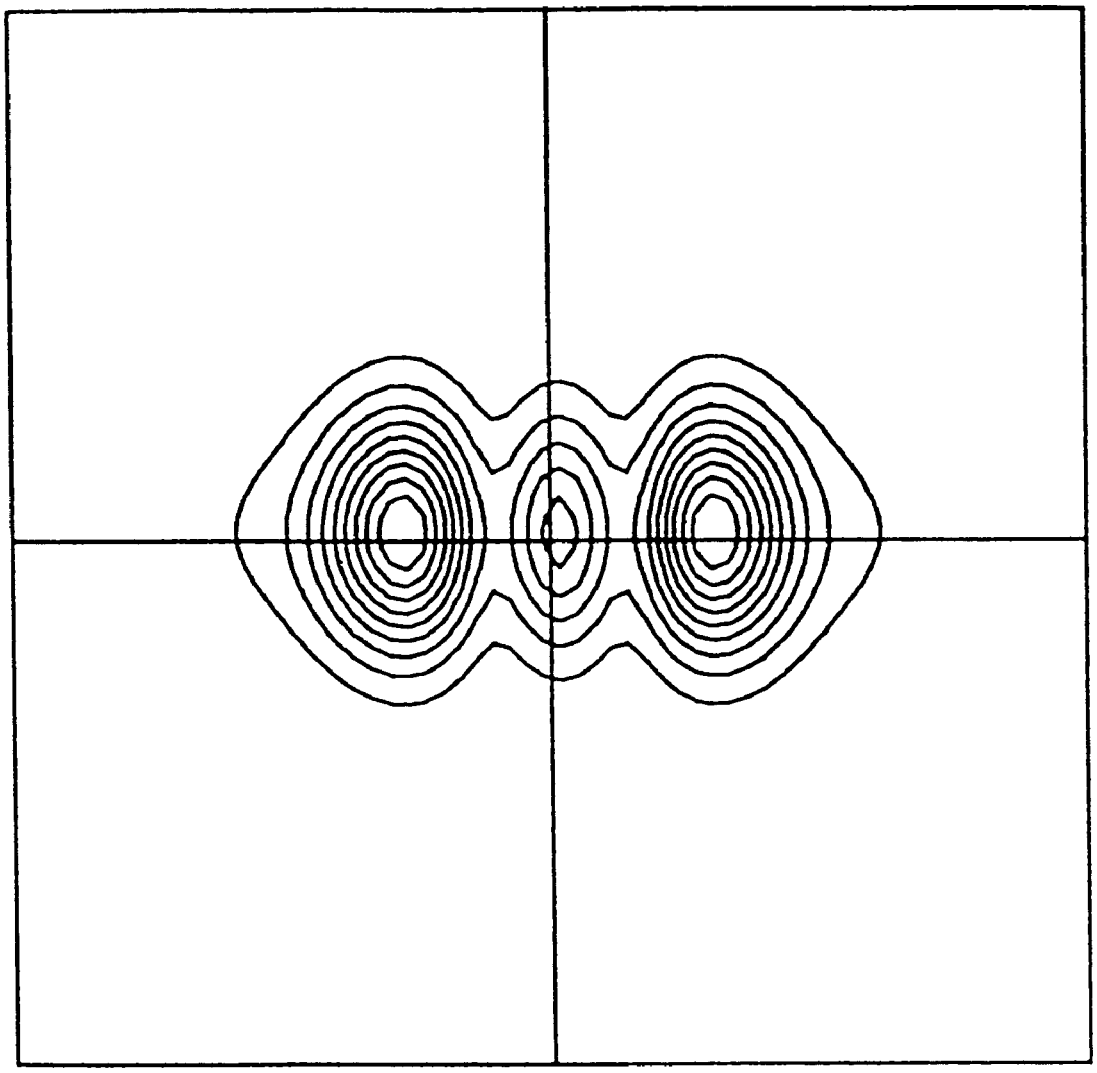
FIG. 9 is a plan view of power distribution of electromagnetic wave beams at the entrance of the electromagnetic wave matching element of the second embodiment.
Figure 10:
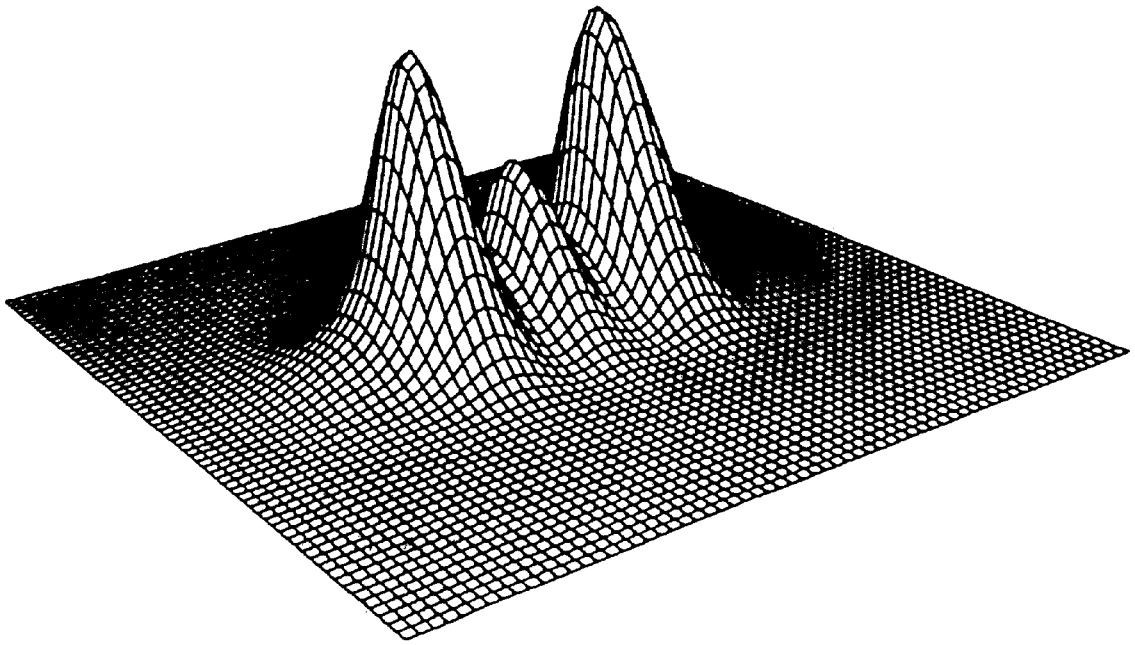
FIG. 10 is a perspective view of power distribution of electromagnetic wave beams at the entrance of the electromagnetic wave matching element of the second embodiment.

The plan view and the perspective view of the intensity distribution of millimeter waves on the reflection mirror 211 according to the electromagnetic wave matching element 200 of this embodiment are respectively shown in FIGS. 9 and 10. FIG. 9 is a plan view in which the intensity distribution of millimeter waves on the reflection mirror 211 is expressed with contour lines. In FIG. 9, a contour line is drawn for every tenth of the maximum value of the intensity distribution. FIG. 10 is a perspective view in which the intensity distribution of millimeter waves on the reflection mirror 211 is expressed with meshes to show the intensity distribution in a three-dimensional perspective.

As has been described above, the electromagnetic wave matching element 200 of this embodiment can also combine two millimeter wave beams outputted from the gyrotron 20 into a desired single millimeter wave beam. Thus, the cost of the transmission system can be reduced.

Figure 11A:
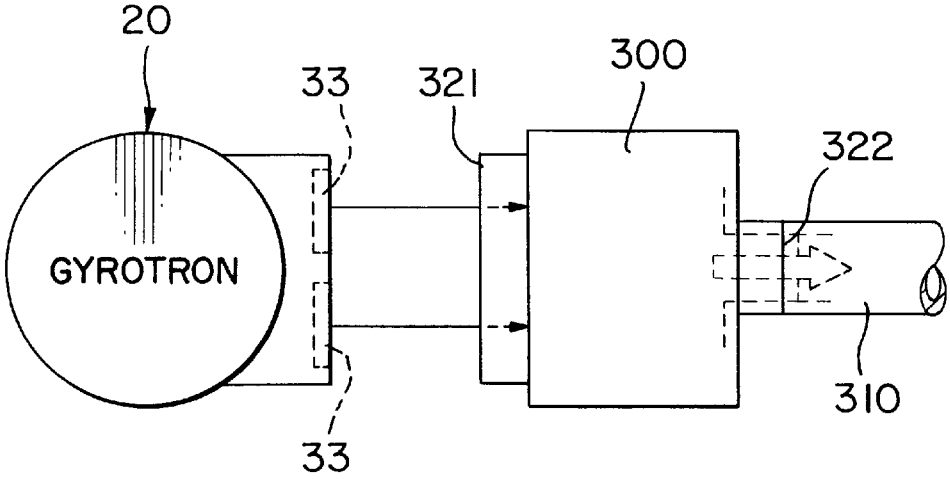
FIG. 11A is a plan view of a third embodiment of an electromagnetic wave matching element according to this invention.
Figure 11B:
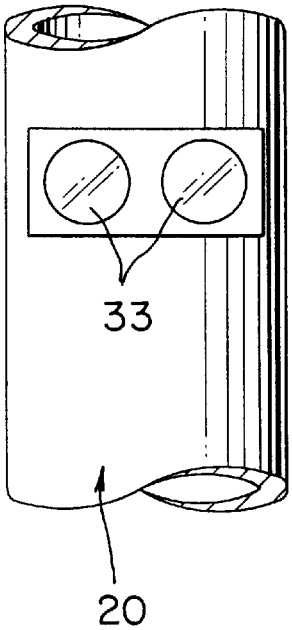
FIG. 11B is a side view in the case where the gyrotron is viewed from the entrance side of the third embodiment.
Figure 11C:
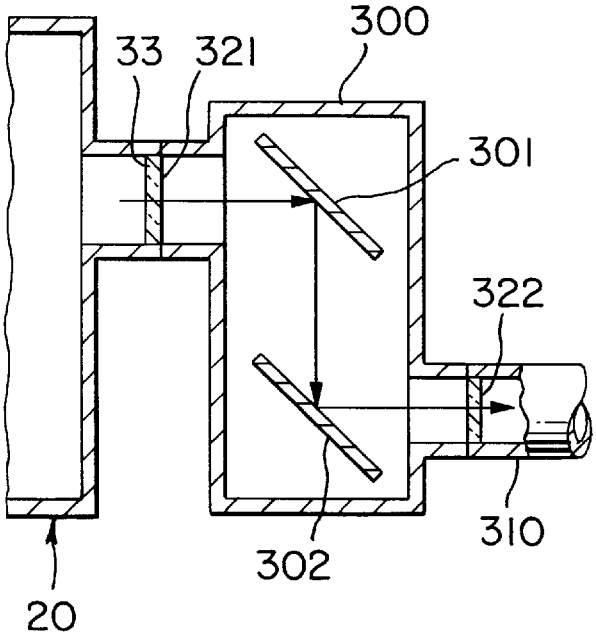
FIG. 11C is a cross sectional view of the third embodiment.

The configuration of a third embodiment of the electromagnetic wave matching element which is the principal part of this invention is shown in FIGS. 11A to 11C. FIG. 11A is a plan view of electromagnetic wave matching element 300 of the third embodiment, FIG. 11B is a side view in the case where gyrotron 20 to which the electromagnetic wave matching element 300 of this embodiment is applied is viewed from the entrance side of the electromagnetic wave matching element 300, and FIG. 11C is a cross sectional view of the electromagnetic wave matching element 300.

The electromagnetic wave matching element 300 (see FIGS. 11A, 11C) of this embodiment is applied to gyrotron 20 adapted for outputting, in parallel, two millimeter wave beams from output windows 33 disposed in a direction perpendicular to the axial direction (direction of axis) of the gyrotron 20, and includes two phase correction mirrors 301, 302 (see FIG. 11C) provided within a space (e.g., in vacuum state) surrounded by a vacuum wall. In operation, millimeter wave beams radiated in parallel from two output windows 33 of the gyrotron 20 are incident to an entrance 321 of the electromagnetic wave matching element 300, and are propagated to the phase correction mirror 301. The millimeter wave beams are then caused to undergo correction of phase by the phase correction mirror 301 so that they are converted into millimeter wave beams of the $HE_{11}$ mode. The millimeter wave beams thus obtained are propagated to a corrugated waveguide 310 through an exit 322 of the electromagnetic wave matching element 300 (as seen in FIG. 11C).

Figure 12:
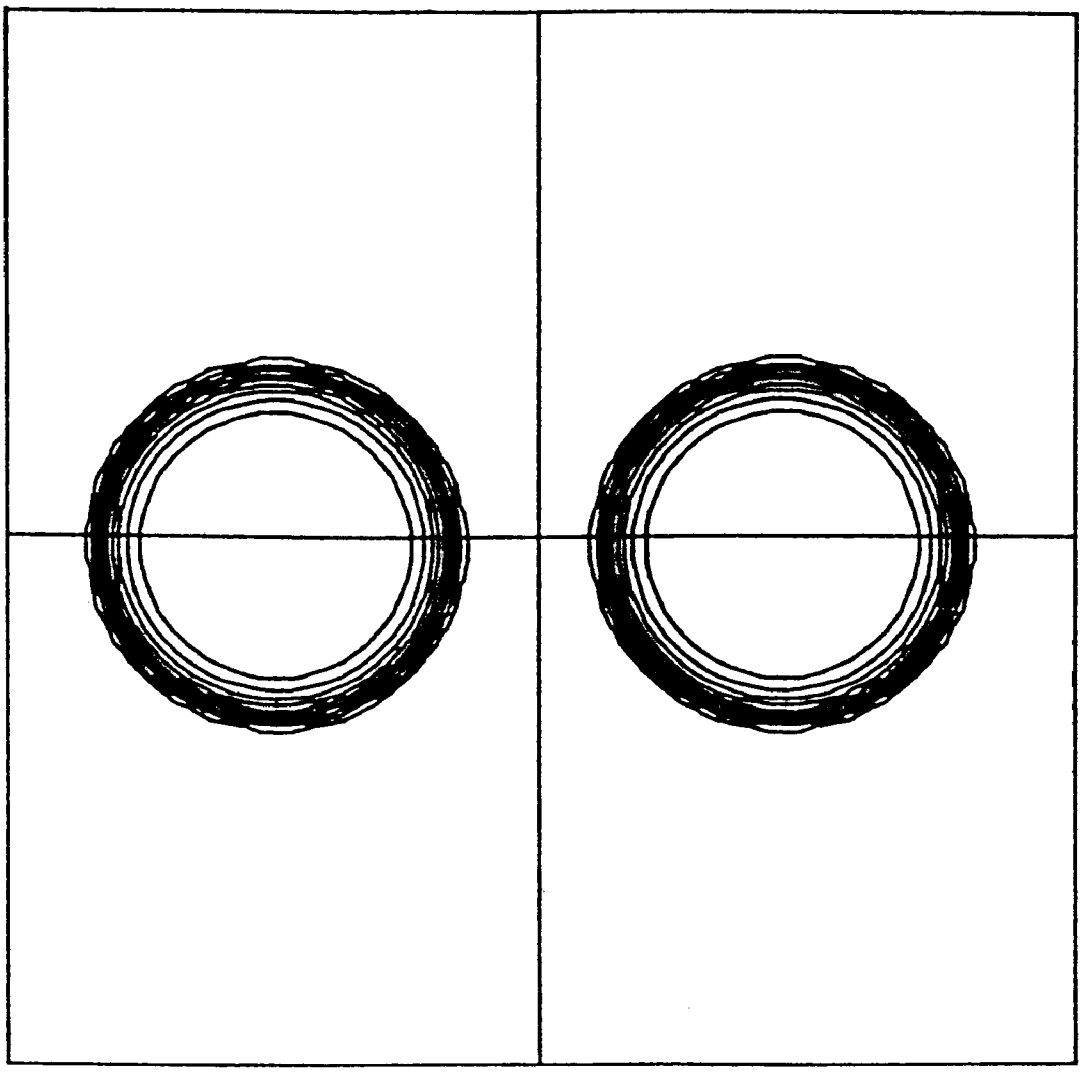
FIG. 12 is a plan view of power distribution of electromagnetic wave beams at the entrance of the electromagnetic wave matching element of the third embodiment.
Figure 13:
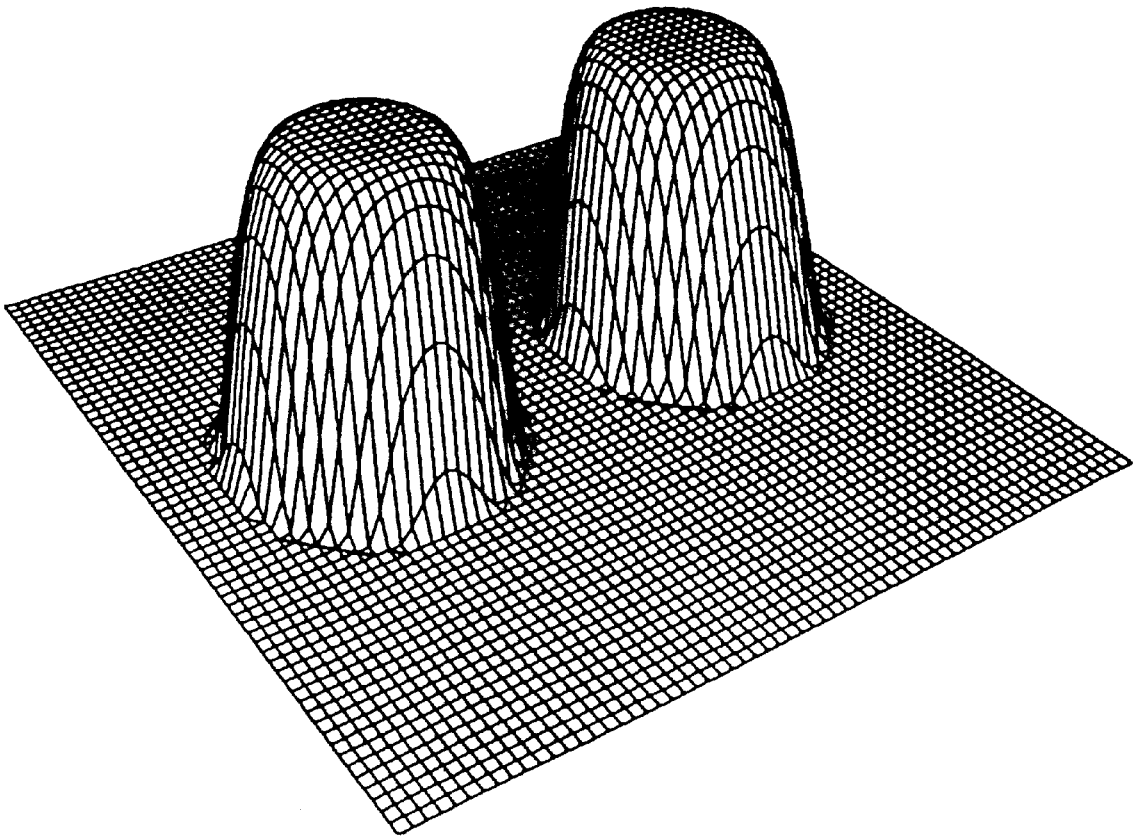
FIG. 13 is a perspective view of power distribution of electromagnetic wave beams at the entrance of the electromagnetic wave matching element of the third embodiment.

The plan view and the perspective view of the intensity distribution of millimeter wave beams at the entrance 321 of the electromagnetic wave matching element 300 at this time are respectively shown in FIGS. 12 and 13. It is seen from this FIG. 13 that the intensity distribution of millimeter waves at the entrance 321 of the electromagnetic wave matching element 300 is flattened. FIG. 12 is a plan view in which the intensity distribution of millimeter wave beams at the entrance 321 is expressed with contour lines. In FIG. 12, a contour line is drawn for every tenth of the maximum value of the intensity distribution. FIG. 13 is a perspective view in which the intensity distribution of millimeter wave beams is expressed with meshes to show the intensity distribution in a three-dimensional perspective.

Also in the electromagnetic wave matching element 300 of the third embodiment, two millimeter wave beams are handled as a single millimeter wave beam, thus making it possible to determine shapes of the phase correction mirrors 301, 302 by employing an approach as described in the first embodiment.

Figure 14A:
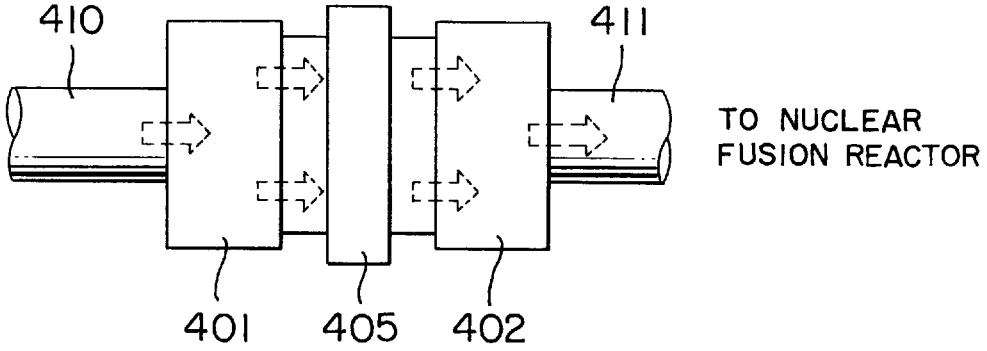
FIG. 14A is a top view in the case where the electromagnetic wave matching element of this invention is applied to the transmission system.
Figure 14B:
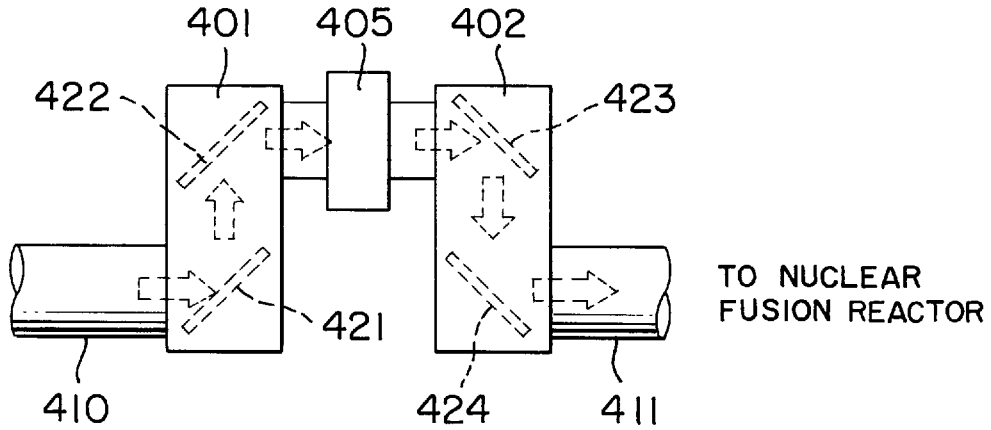
FIG. 14B is a side view in the case where the electromagnetic wave matching element of this invention is applied to the transmission system.

An example where the electromagnetic wave matching element according to this invention is used in a transmission system is shown in FIGS. 14A and 14B. An electromagnetic wave matching element 401 of this example is used in the transmission system, and serves to separate a single millimeter wave into plural millimeter waves. Moreover, an electromagnetic wave matching element 402 serves to couple or combine plural millimeter waves into a single millimeter wave. In FIGS. 14A and 14B, millimeter waves transmitted by a corrugate wave guide 410 is separated into two millimeter wave beams by the electromagnetic wave matching element 401 using two phase correction mirrors 421, 422 (see FIG. 14B) to allow them to be passed through a dielectric window 405 thereafter to change them into a single millimeter wave beam for a second time by the electromagnetic wave matching element 402 using two phase correction mirrors 423, 424 (see FIG. 14B). The single millimeter wave beam is outputted to a nuclear fusion reactor through a corrugate waveguide 411. By employing such an approach, thermal load per each dielectric window 405 used in the transmission system can be reduced.

Figure 15A:
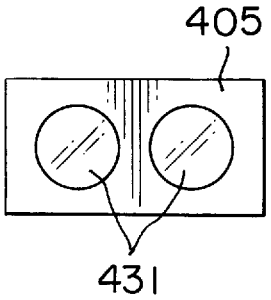
FIGS. 15A and 15B are model views showing examples of dielectric windows used in the example shown in FIGS. 14A and 14B.
Figure 15B:
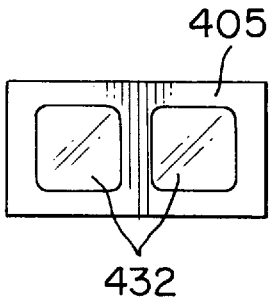

The model view in the case where the dielectric window 405 is viewed from the electromagnetic wave matching elements 401, 402 is shown in FIG. 15A or FIG. 15B. In these figures, reference numerals 431 (see FIG. 15A), 432 (see FIG. 15B), denote a dielectric body. There may be employed windows of any form, such as, for example, edge cooling window of single disk, surface cooling window of double disk, cryo-window, and distribution window, etc.

Moreover, while the example where millimeter wave beam is separated into two millimeter wave beams to allow them to be passed through the dielectric window is disclosed in the above-described embodiment, the millimeter wave beam may be separated into three millimeter wave beams or more when the millimeter wave power is caused to be large.

Figure 16A:
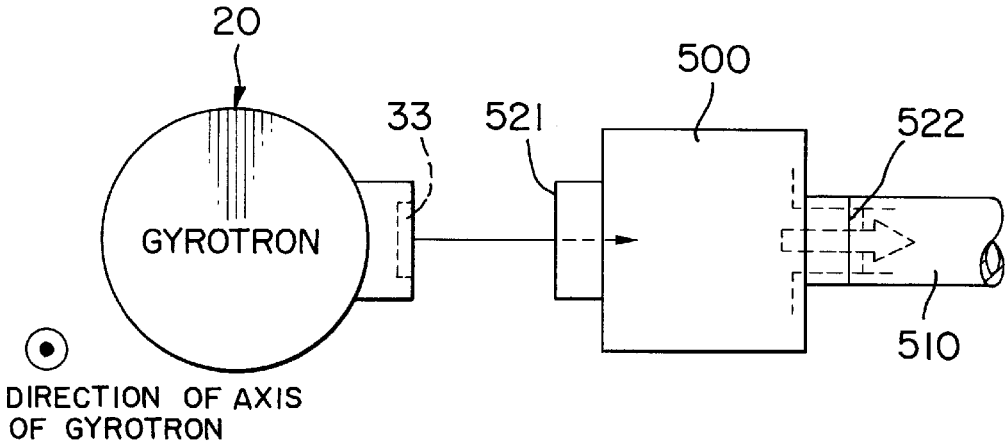
FIG. 16A is a top view of a fourth embodiment of an electromagnetic wave matching element according to this invention.
Figure 16B:
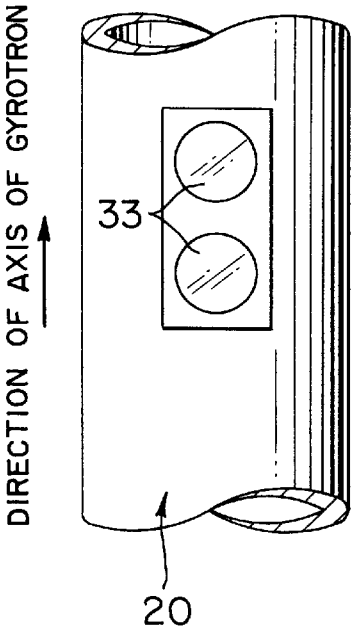
FIG. 16B is a side view in the case where the gyrotron is viewed from the entrance of the fourth embodiment.
Figure 16C:
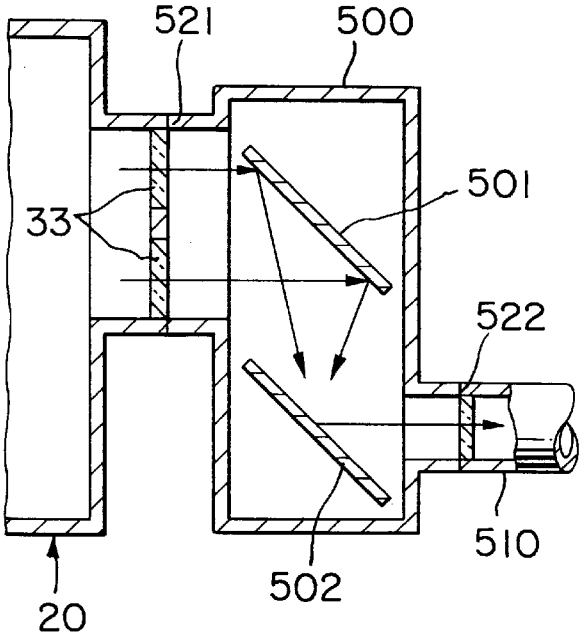
FIG. 16C is a cross sectional view of the fourth embodiment.

The configuration of a fourth embodiment of the electromagnetic wave matching element which is the principal part of this invention is shown in FIGS. 16A to 16C. FIG. 16A is a top view of electromagnetic wave matching element 500 of the fourth embodiment, FIG. 16B is a side view in the case where the gyrotron 20 to which the electromagnetic wave matching element 500 of this embodiment is applied is viewed from the entrance side of the electromagnetic wave matching element 500, and FIG. 16C is a cross sectional view of the electromagnetic wave matching element 500.

The electromagnetic wave matching element 500 of this embodiment is applied to gyrotron 20 adapted for outputting, in parallel, two millimeter wave beams from output windows 33 disposed in the axial direction of the gyrotron 20, and includes two phase correction mirrors 501, 502 (see FIG. 16C) provided within the space (e.g., in vacuum state) surrounded by the vacuum wall. Millimeter wave beams radiated in parallel from two output windows 33 of the gyrotron 20 are incident to an entrance 521 (see FIGS. 16A, 16C) of the electromagnetic wave matching element 500, and are propagated to the phase correction mirror 501. Then, the phase of the millimeter wave beams is corrected by the phase correction mirror 501 so that these millimeter wave beams are converted into millimeter wave beams of the $HE_{11}$ mode. The millimeter wave beams thus obtained are propagated to a corrugated waveguide 510 through an exit 522 of the electromagnetic wave matching element 500 (see FIGS. 16A, 16C).

Figure 17:
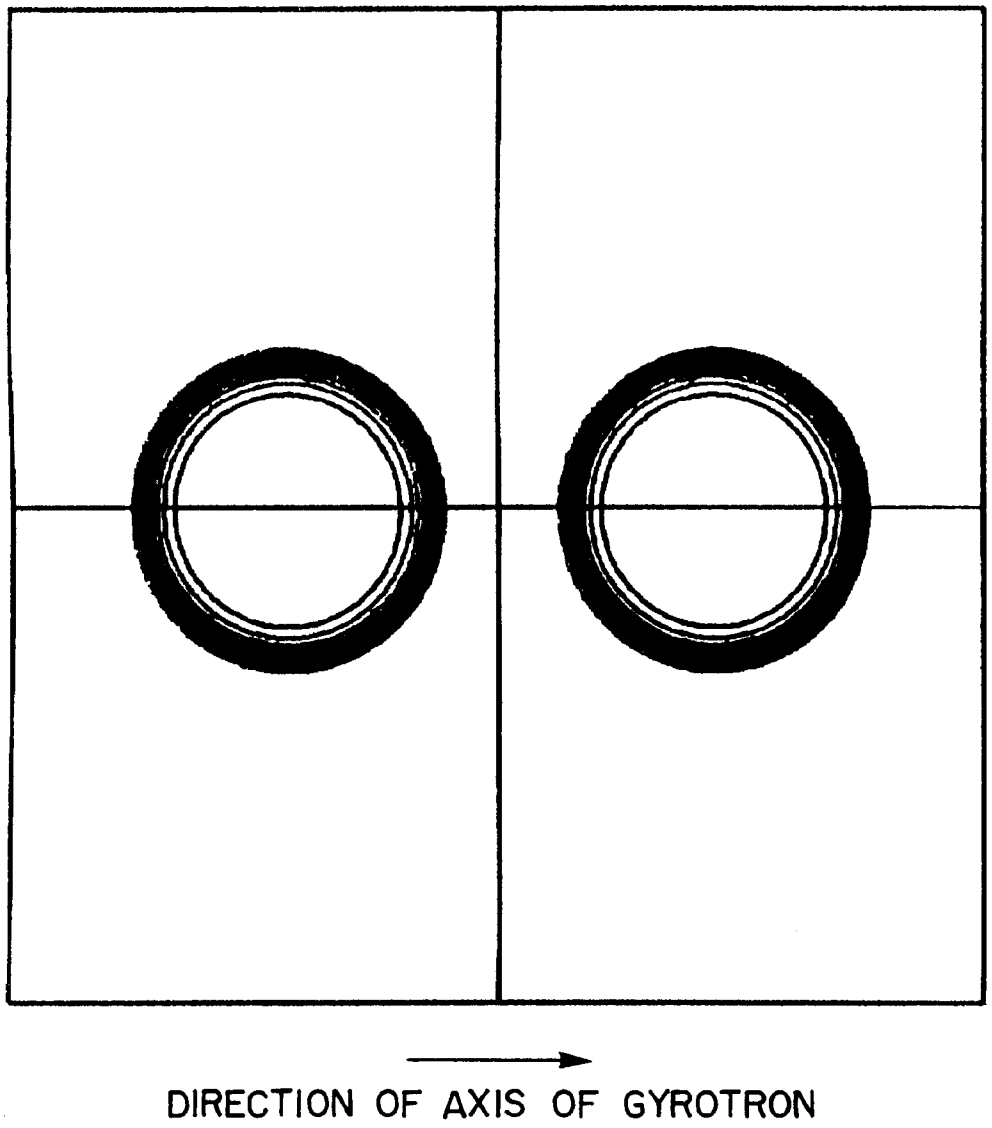
FIG. 17 is a plan view of power distribution of electromagnetic wave beams at the entrance of the electromagnetic wave matching element of the fourth embodiment.
Figure 18:
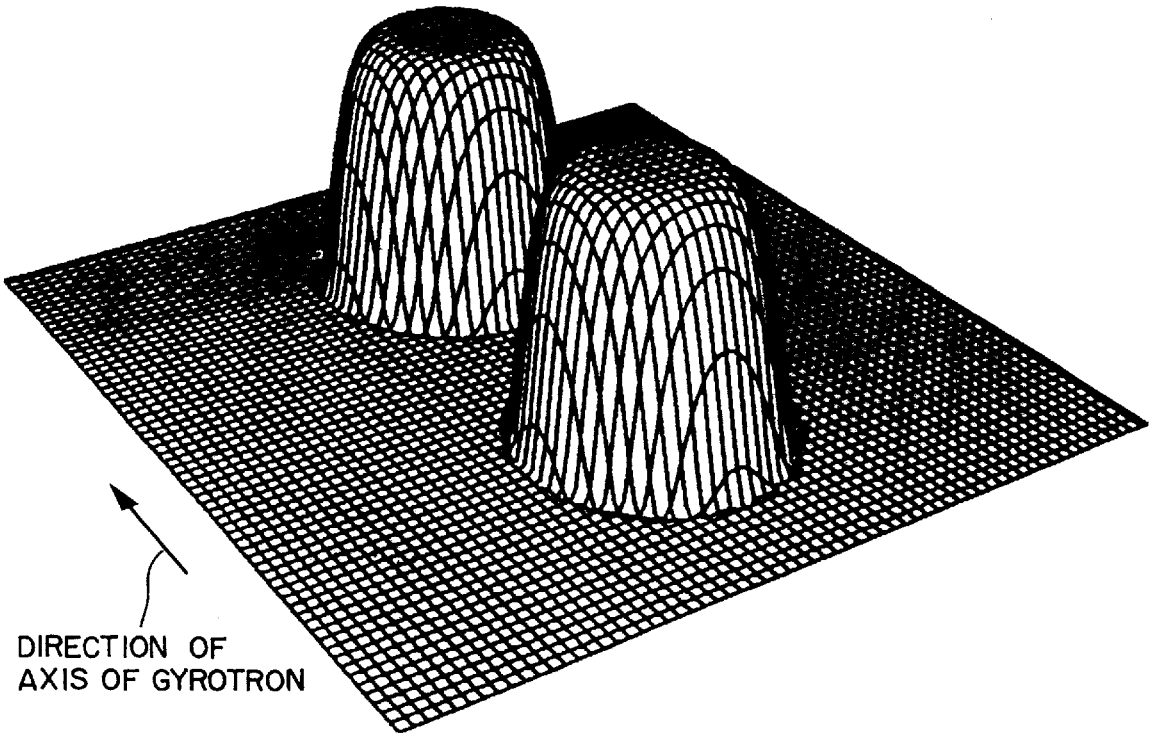
FIG. 18 is a perspective view of power distribution of electromagnetic wave beams at the entrance of the electromagnetic wave matching element of the fourth embodiment.

The plan view and the perspective view of the intensity distribution of millimeter wave beams at the entrance 521 of the electromagnetic matching element 500 at this time are respectively shown in FIGS. 17 and 18. It is seen from FIG. 18 that the intensity distribution of millimeter waves at the entrance 521 of the electromagnetic wave matching element 500 is flattened. FIG. 17 is a plan view in which the intensity distribution of millimeter wave beams at the entrance 521 is expressed with contour lines. In FIG. 17, a contour line is drawn for every tenth of the maximum value of the intensity distribution. FIG. 18 is a perspective view in which the intensity distribution of millimeter wave beams is expressed with meshes to show the intensity distribution in a three-dimensional perspective.

Also in the electromagnetic wave matching element 500 of the fourth embodiment, two millimeter wave beams are dealt as a single millimeter wave beam, thus making it possible to determine shapes of the phase correction mirrors 501, 502 by employing such an approach as described in the first embodiment.

Figure 19A:
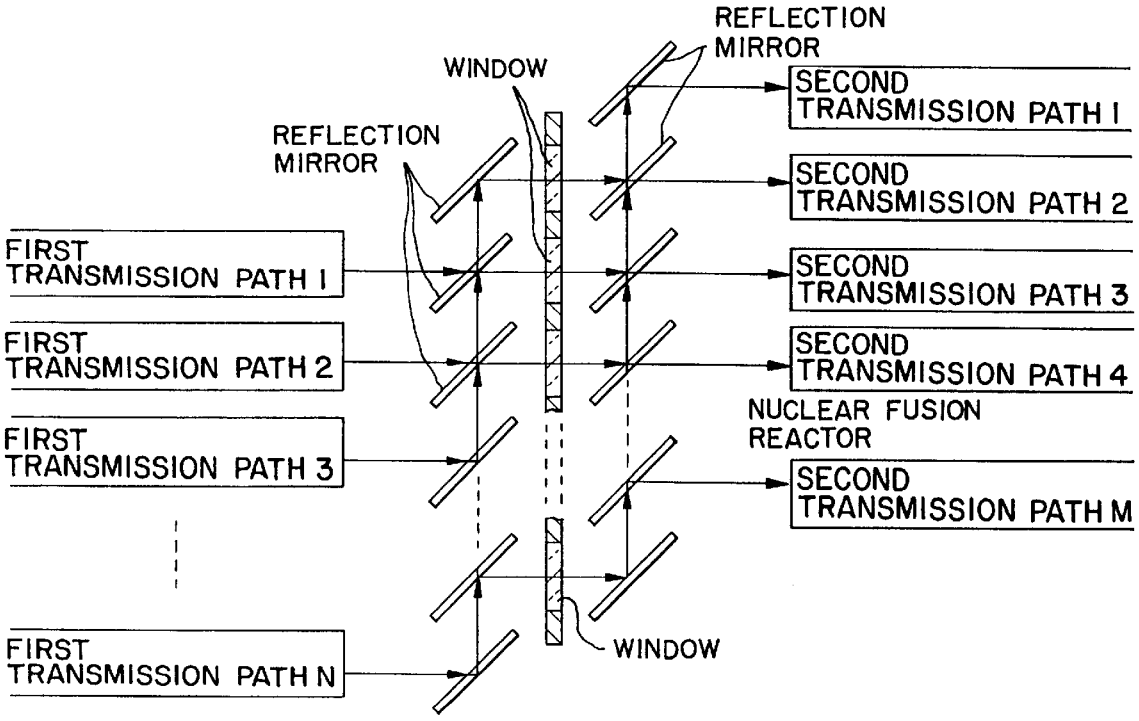
FIG. 19A is an explanatory view in the case where the electromagnetic wave matching element of this invention is used at vacuum window portion connecting the transmission system and the nuclear fusion reactor body.
Figure 19B:
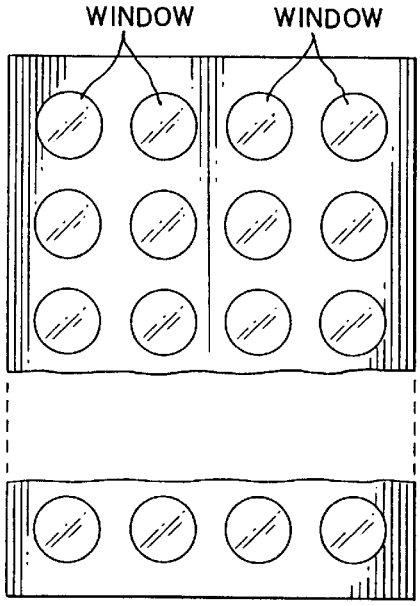
FIG. 19B is a front view of the vacuum window portion when viewed from the nuclear fusion reactor side.

The example where plural electromagnetic wave matching elements according to this invention are used to conduct millimeter waves to the nuclear fusion reactor is shown in FIGS. 19A and 19B. FIG. 19A is an explanatory view in the case where the electromagnetic wave matching elements of this invention are used at the vacuum window portion, and FIG. 19B is a front view of the vacuum window portion when viewed from the nuclear fusion reactor side. When operated, the nuclear fusion reactor is maintained in the vacuum state. Therefore, normally dielectric vacuum windows are provided to the nuclear fusion reactor in order to transmit millimeter waves into a nuclear fusion plasma for heating. When the power of electromagnetic waves incident on the plasma increases, it is likely that the vacuum windows get damaged because of a rise in temperature of the vacuum windows. Therefore, in order to lessen the thermal load per each window, millimeter waves transmitted through transmission paths 1, 2, 3, . . . N are separated into plural (four in this example) millimeter waves by the mirrors in FIG. 19A. The respective millimeter waves separated into four millimeter waves sent to the nuclear fusion reactor through second transmission paths, and they are combined for a second time by mirrors at the nuclear fusion reactor body side as occasion demands. In FIGS. 19A and 19B, electromagnetic waves transmitted through vertically placed transmission paths 1, 2, 3, . . . N are separated to make four horizontally emitted beams per each transmission path. The 4×N beams are transmitted through 4×N vacuum windows arranged in a matrix pattern, thereby lessening the thermal load on each window.

It is to be noted that while, in the electromagnetic wave matching elements of the above-described embodiments, two phase correction mirrors are used to make a conversion from two millimeter waves of which intensity distribution has been flattened to millimeter waves of the $HE_{11}$ mode, it is needless to say that three phase correction mirrors or more may be used to carry out such a conversion. It should be noted that according as the number of phase correction mirrors is increased, the performance of the matching element is improved to more degree.

Further, it is not necessarily required that the space surrounded by the vacuum wall is in a vacuum state, but insulating gas may be hermetically sealed therewithin.

In addition, while millimeter waves are used as the electromagnetic wave in the electromagnetic wave matching elements of the above-described embodiments, microwave may be used for this purpose.

As has been described above, in accordance with this invention, inputted plural electromagnetic wave beams can be changed (converted) into electromagnetic wave beams having desired intensity and phase distribution in which the number of electromagnetic wave beams is different from the number of inputted electromagnetic wave beams. Thus, the cost of the transmission system can be reduced to a great degree.

What is claimed is:

1. An electromagnetic wave matching element, comprising:

a body portion within which insulating gas is hermetically sealed;

an entrance portion provided at the body portion, the entrance portion receiving incident electromagnetic wave beams having a single frequency from a plurality of first transmission lines arranged in a first matrix pattern;

a plurality of mirrors provided within the body portion, the plurality of mirrors allowing the plurality of incident electromagnetic wave beams to be reflected in order to transmit the plurality of electromagnetic wave beams; and an exit portion provided at the body portion, the exit portion coupling the transmit electromagnetic wave beams to an external transmission system having a plurality of second transmission lines, said plurality of first transmission lines being different in number from said plurality of second transmission lines, wherein at least two of the plurality of mirrors are phase correction mirrors, and wherein a respective surface shape of said phase correction mirrors is determined so that a phase distribution of the plurality of incident electromagnetic wave beams with respect to the reflecting surface of the corresponding phase correction mirror when said incident electromagnetic wave beams are caused to travel to the corresponding phase correction mirror indicates a complex conjugate relationship with respect to a distribution provided by electromagnetic wave beams traveling in an opposite direction at the reflecting surface of the corresponding phase correction mirror when electromagnetic waves having a desired distribution at the exit are caused to travel in the opposite direction so that said electromagnetic waves at the exit are propagated to the corresponding phase correction mirror.

2. An electromagnetic wave matching element as set forth in claim 1, wherein said plurality of second transmission lines are smaller in number than said plurality of first transmission lines.

3. An electromagnetic wave matching element for receiving electromagnetic waves having a single frequency from a plurality of first transmission lines arranged in a first matrix pattern, coupling the electromagnetic waves to an external transmission system through an exit, and suppressing reflection waves from the external transmission system, said external transmission system having a plurality of second transmission lines, said plurality of first transmission lines being different in number from said plurality of second transmission lines, said plurality of second transmission lines being arranged in a second matrix pattern, said electromagnetic wave matching element comprising a plurality of mirrors each having a shape to receive the electromagnetic waves in a beam from said plurality of first transmission lines, to output the electromagnetic wave beams having a predetermined distribution to said plurality of second transmission lines, respectively, the electromagnetic wave beams being output having a same operating frequency as the electromagnetic wave beams received from said plurality of first transmission lines.

4. An electromagnetic wave matching element as set forth in claim 3, wherein said plurality of second transmission lines are smaller in number than said plurality of first transmission lines.

5. An electromagnetic wave matching element as set forth in claim 3, wherein at least two of said plurality of mirrors are phase correction mirrors, and each of said phase correction mirrors has a respective shape to change a local phase of said electromagnetic wave beams incident to a reflecting surface of the corresponding phase correction mirror by a predetermined quantity.

6. An electromagnetic wave matching element as set forth in claim 5, wherein said plurality of second transmission lines are smaller in number than said plurality of first transmission lines.

7. An electromagnetic wave matching element as set forth in claim 5, wherein a respective surface shape of said phase correction mirrors is determined so that a phase distribution of said incident electromagnetic wave beams with respect to the reflecting surface of the corresponding phase correction mirror when said incident electromagnetic wave beams are caused to travel to the corresponding phase correction mirror indicates a complex conjugate relationship with respect to a distribution provided by electromagnetic wave beams traveling in an opposite direction at the reflecting surface of the corresponding phase correction mirror when electromagnetic waves having a desired distribution at the exit are caused to travel in the opposite direction so that said electromagnetic waves at the exit are propagated to the corresponding phase correction mirror.

8. An electromagnetic wave matching element as set forth in claim 7, wherein said plurality of second transmission lines are smaller in number than said plurality of first transmission lines.

9. An electromagnetic wave matching element comprising:

a body portion having a vacuum state therewithin;

an entrance portion provided at the body portion, the entrance portion receiving a plurality of incident electromagnetic wave beams having a single frequency from a plurality of first transmission lines arranged in a first matrix pattern;

a plurality of mirrors provided within the body portion, the plurality of mirrors allowing the plurality of incident electromagnetic wave beams to be reflected in order to transmit the plurality of electromagnetic wave beams; and an exit portion provided at the body portion, the exit portion coupling the transmit electromagnetic wave beams to an external transmission system having a plurality of second transmission lines, said plurality of first transmission lines being different in number from said plurality of second transmission lines, wherein said plurality of mirrors each have a shape to receive the plurality of incident electromagnetic wave beams from said plurality of first transmission lines to output the transmit electromagnetic wave beams each having a predetermined distribution to said plurality of second transmission lines, respectively, the transmit electromagnetic wave beams having a same operating frequency as the plurality of incident electromagnetic wave beams.

10. An electromagnetic wave matching element as set forth in claim 9, wherein said plurality of second transmission lines are smaller in number than said plurality of first transmission lines.

11. An electromagnetic wave matching element as set forth in claim 9, wherein at least two of said plurality of mirrors are phase correction mirrors, and each of said phase correction mirrors has a respective shape to change a local phase of the plurality of electromagnetic wave beams incident to a reflecting surface of the corresponding phase correction mirror by a predetermined quantity.

12. An electromagnetic wave matching element as set forth in claim 11, wherein said plurality of second transmission lines are smaller in number than said plurality of first transmission lines.

13. An electromagnetic wave matching element, comprising:

a body portion having a vacuum state therewithin;

an entrance portion provided at the body portion, the entrance portion receiving a plurality of incident electromagnetic wave beams having a single frequency from a plurality of first transmission lines arranged in a first matrix pattern;

a plurality of mirrors provided within the body portion, the plurality of mirrors allowing the plurality of incident electromagnetic wave beams to be reflected in order to transmit the plurality of electromagnetic wave beams; and an exit portion provided at the body portion, the exit portion coupling the transmit electromagnetic wave beams to an external transmission system having a plurality of second transmission lines, said plurality of first transmission lines being different in number from said plurality of second transmission lines, wherein at least two of the plurality of mirrors are phase correction mirrors, and wherein a respective surface shape of said phase correction mirrors is determined so that a phase distribution of the plurality of incident electromagnetic wave beams with respect to the reflecting surface of the corresponding phase correction mirror when said incident electromagnetic wave beams are caused to travel to the corresponding phase correction mirror indicates a complex conjugate relationship with respect to a distribution provided by electromagnetic wave beams traveling in an opposite direction at the reflecting surface of the corresponding phase correction mirror when electromagnetic waves having a desired distribution at the exit are caused to travel in the opposite direction so that said electromagnetic waves at the exit are propagated to the corresponding phase correction mirror.

14. An electromagnetic wave matching element as set forth in claim 13, wherein said plurality of second transmission lines are smaller in number than said plurality of first transmission lines.

15. An electromagnetic wave matching element, comprising:

a body portion within which insulating gas is hermetically sealed;

an entrance portion provided at the body portion, the entrance portion receiving incident electromagnetic wave beams having a single frequency from a plurality of first transmission lines arranged in a first matrix pattern;

a plurality of mirrors provided within the body portion, the plurality of mirrors allowing the plurality of incident electromagnetic wave beams to be reflected in order to transmit the plurality of electromagnetic wave beams; and an exit portion provided at the body portion, the exit portion coupling the transmit electromagnetic wave beams to an external transmission system having a plurality of second transmission lines, said plurality of first transmission lines being different in number from said plurality of second transmission lines, wherein said plurality of mirrors each have a shape to receive the plurality of incident electromagnetic wave beams from the plurality of first transmission lines to output the transmit electromagnetic wave beams each having a predetermined distribution to the plurality of second transmission lines, respectively.

16. An electromagnetic wave matching element as set forth in claim 15, wherein said plurality of second transmission lines are smaller in number than said plurality of first transmission lines.

17. An electromagnetic wave matching element as set forth in claim 15, wherein at least two of said plurality of mirrors are phase correction mirrors, and each of said phase correction mirrors has a respective shape to change a local phase of the plurality of electromagnetic wave beams incident to a reflecting surface of the corresponding phase correction mirror by a predetermined quantity.

18. An electromagnetic wave matching element as set forth in claim 17, wherein said plurality of second transmission lines are smaller in number than said plurality of first transmission lines.

* * * * *